US007113135B2

(12) United States Patent
Jo et al.

(10) Patent No.: US 7,113,135 B2
(45) Date of Patent: Sep. 26, 2006

(54) TRI-BAND ANTENNA FOR DIGITAL MULTIMEDIA BROADCAST (DMB) APPLICATIONS

(75) Inventors: Young-Min Jo, Rockledge, FL (US); Frank M. Caimi, Vero Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/863,809

(22) Filed: Jun. 8, 2004

(65) Prior Publication Data

US 2005/0270238 A1 Dec. 8, 2005

(51) Int. Cl.
*H01Q 1/24* (2006.01)

(52) U.S. Cl. ..... 343/702; 343/700 MS; 343/895

(58) Field of Classification Search ..... 343/702
See application file for complete search history.

(56) References Cited

U.S. PATENT DOCUMENTS 3,838,429 A 9/1974 Reggia
3,925,784 A 12/1975 Phelan
4,207,574 A * 6/1980 Toia ..... 343/752
4,495,503 A 1/1985 Morman
4,598,276 A 7/1986 Tait
4,847,625 A 7/1989 Dietrich et al.
5,313,216 A 5/1994 Wang et al.
5,497,164 A 3/1996 Croq
5,608,417 A 3/1997 de Vall
5,680,144 A 10/1997 Sanad
5,691,731 A 11/1997 van Erven
5,757,333 A 5/1998 Kitchener
5,790,080 A 8/1998 Apostolos
5,926,137 A 7/1999 Nealy
5,929,825 A 7/1999 Niu et al.
5,999,132 A * 12/1999 Kitchener et al. ..... 343/702
6,005,525 A 12/1999 Kivela
6,057,802 A 5/2000 Nealy et al.
6,064,351 A 5/2000 Mandai et al.
6,094,170 A 7/2000 Peng
6,137,445 A 10/2000 Ha et al.
6,137,453 A 10/2000 Wang et al.
6,166,694 A 12/2000 Ying
6,229,487 B1 5/2001 Sadler et al.
6,304,222 B1 10/2001 Smith et al.
6,320,544 B1 11/2001 Korisch et al.
6,323,814 B1 11/2001 Apostolos
6,353,420 B1 3/2002 Chung
6,353,443 B1 3/2002 Ying
6,476,769 B1 11/2002 Lehtola
6,489,925 B1 12/2002 Thursby et al.

(Continued)

OTHER PUBLICATIONS

Harvey, A. F.; "Periodic and Guiding Structures at Microwave Frequencies"; IRE Transactions on Microwave Theory and Techniques; Jan. 1960; pp. 30-61.

*Primary Examiner*—Wilson Lee
*Assistant Examiner*—Binh Van Ho
(74) *Attorney, Agent, or Firm*—John L. DeAngelis; Beusse, Wolter, Sanks, Mora & Maire, P.A.

(57) ABSTRACT

A radio frequency transmitting and receiving apparatus comprising an antenna further comprising a plurality of antenna segments. Each segment exhibits a different electrical length and certain of the segments are capacitively coupled to establish a resonant frequency for each segment. In one embodiment, the certain segments comprise a plurality of concentric arcuate conductive elements connected to a signal terminal and a ground plane.

31 Claims, 4 Drawing Sheets

U.S. PATENT DOCUMENTS 6,492,953 B1 12/2002 Apostolos
6,559,811 B1 * 5/2003 Pulimi et al. ..... 343/895
6,573,869 B1 6/2003 Moore
6,590,543 B1 7/2003 Apostolos
6,819,302 B1 * 11/2004 Volman ..... 343/895
2001/0002035 A1 5/2001 Kayanakis
2003/0210200 A1 * 11/2003 McConnell ..... 343/795
2004/0145523 A1 * 7/2004 Shamblin et al. .... 343/700 MS

* cited by examiner

TRI-BAND ANTENNA FOR DIGITAL MULTIMEDIA BROADCAST (DMB) APPLICATIONS

FIELD OF THE INVENTION

The present invention is directed generally to an antenna for transmitting and receiving electromagnetic signals, and more specifically to an antenna for integration into a portable or handheld device for receiving and transmitting the electromagnetic signals via the antenna.

BACKGROUND OF THE INVENTION

It is known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity, signal polarization and radiation pattern.

Generally, an operable antenna should have a minimum physical antenna dimension approximately equal to a half wavelength (or a quarter wavelength above a ground plane) (or a multiple thereof) of the operating frequency to limit energy dissipated in resistive losses and maximize transmitted or received energy. A quarter wavelength antenna (or multiples of a quarter wavelength) operative above a ground plane exhibits properties similar to a half wavelength antenna. Designers of communications products prefer an efficient antenna that is capable of wide bandwidth and/or multiple frequency band operation, electrically matched to the transmitting and receiving components of the communications system, and operable in multiple modes (e.g., selectable signal polarizations and selectable radiation patterns). Quarter wavelength and half wavelength antennas are the most commonly used.

The half-wavelength dipole antenna finds use in many applications. The radiation pattern is the familiar donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna disposed above a ground plane is derived from the half-wavelength dipole. The physical antenna length is a quarter wavelength, but interaction of the electromagnetic energy with the ground plane causes the antenna to exhibit half wavelength dipole properties. Thus, the radiation pattern for a monopole antenna above a ground plane is similar to the half-wavelength dipole pattern, with a typical gain of approximately 2 dBi.

Given the advantageous performance of quarter and half-wavelength antennas, conventional antennas are typically constructed so that the antenna length is on the order of a quarter wavelength of the radiating frequency and the antenna is operated over a ground plane or the antenna length is a half wavelength without employing a ground plane. These dimensions allow the antenna to be easily excited and operated at or near a resonant frequency (where the resonant frequency (f) is determined according to the equation $c=\lambda f$, where c is the speed of light and $\lambda$ is the wavelength of the electromagnetic radiation). Half and quarter wavelength antennas limit energy dissipated in resistive losses and maximize the transmitted energy. As the operating frequency increases/decreases, the operating wavelength decreases/increases and the antenna element dimensions proportionally decrease/increase. In particular, as the resonant frequency of the received or transmitted signal decreases, the dimensions of the quarter-wavelength and half-wavelength antenna proportionally increase. The resulting larger antenna, even at a quarter wavelength, may not be suitable for use with certain communications devices, especially portable and personal communications devices intended to be carried by a user. Such antennas can protrude from the communications device and thus are susceptible to breakage The burgeoning growth of wireless communications devices and systems has created a substantial need for physically smaller, less obtrusive and more efficient antennas capable of wide bandwidth or multiple frequency-band operation. It is also desired that the antennas operate in multiple modes (i.e., selectable radiation patterns or selectable signal polarizations). For example, operation in multiple frequency bands may be required for operation of the communications device with multiple communications systems, such as a cellular telephone system and a cordless telephone system. Operation of the device in multiple countries also requires multiple frequency band operation since communications frequencies are not commonly assigned among countries.

Smaller packaging of state-of-the-art communications devices, such as personal handsets, does not provide sufficient space for the conventional quarter and half wavelength antenna elements. Generally, it is not considered feasible to utilize one antenna for each operating frequency or to include multiple matching circuits to provide proper resonant frequency operation at several different frequencies for a single antenna. Thus physically smaller antennas operating in frequency bands of interest and providing the other desired antenna properties (input impedance, radiation pattern, signal polarizations, etc.) are especially sought after.

As is known to those skilled in the art, there is a direct relationship between physical antenna size and antenna gain for a single-element antenna, according to the relationship: $gain=(\beta R)\hat{}2+2\beta R$, where R is the radius of the sphere containing the antenna and $\beta$ is the propagation factor or phase constant. Increased gain thus requires a physically larger antenna, while users continue to demand physically smaller antennas. As a further design constraint, to simplify the system design and strive for minimum cost, equipment designers and system operators prefer to utilize antennas capable of efficient multi-band and/or wide bandwidth operation, thus permitting the communications device to access various wireless services operating within different frequency bands or services operating over wide bandwidths. Finally, gain is limited by the known relationship between the antenna operating frequency and the effective antenna length (expressed in wavelengths). That is, the antenna gain is constant for all quarter-wavelength antennas of a specific geometry i.e., at that operating frequency where the effective antenna length is a quarter of the operating frequency wavelength.

To overcome the size limitations of handset and personal communications devices, antenna designers have turned to the use of so-called slow wave structures where the structure's physical dimensions are not equal to the effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one for which the phase velocity of the traveling wave is less than the free space velocity of light. The wave velocity is the product of the wavelength and the frequency and takes into account the material permittivity and permeability, i.e., $c/((\mathrm{sqrt}(\epsilon_r)\mathrm{sqrt}(\mu_r))=\lambda f$. Since the frequency remains unchanged during propagation through a slow wave structure, if the wave travels slower (i.e., the phase velocity is lower) than the speed of light, the wavelength within the structure is lower than the free space wavelength. The slow-wave structure de-couples the conventional relationship between physical length, resonant frequency and wavelength.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating a slow wave will be physically smaller than the structure propagating a wave at the speed of light. Such slow wave structures can be used as antenna elements or as antenna radiating structures.

SUMMARY OF THE INVENTION

In one embodiment, the present invention comprises an antenna for receiving radio frequency signals. The antenna further comprises a first resonant segment having a shape of a substantially closed curve with an opening defined therein, and a second resonant segment. A third resonant segment extends through the opening into an interior region defined by the closed curve; the third segment is conductively connected to the first segment. The second segment is conductively connected to one of the first segment and the third segment. The first segment is resonant at a first frequency, the second segment is resonant at a second frequency and the third segment is resonant at a third frequency.

BRIEF DESCRIPTION OF THE DRAWINGS

The features of the antenna constructed according to the teachings of the present invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Before describing in detail the particular antenna in accordance with the present invention, it should be observed that the present invention resides primarily in a novel and non-obvious combination of elements. So as not to obscure the disclosure with details that will be readily apparent to those skilled in the art, certain conventional elements and steps have been described and illustrated with lesser detail, while other elements and steps more pertinent to understanding the invention have been described and illustrated in greater detail.

Figure 1:
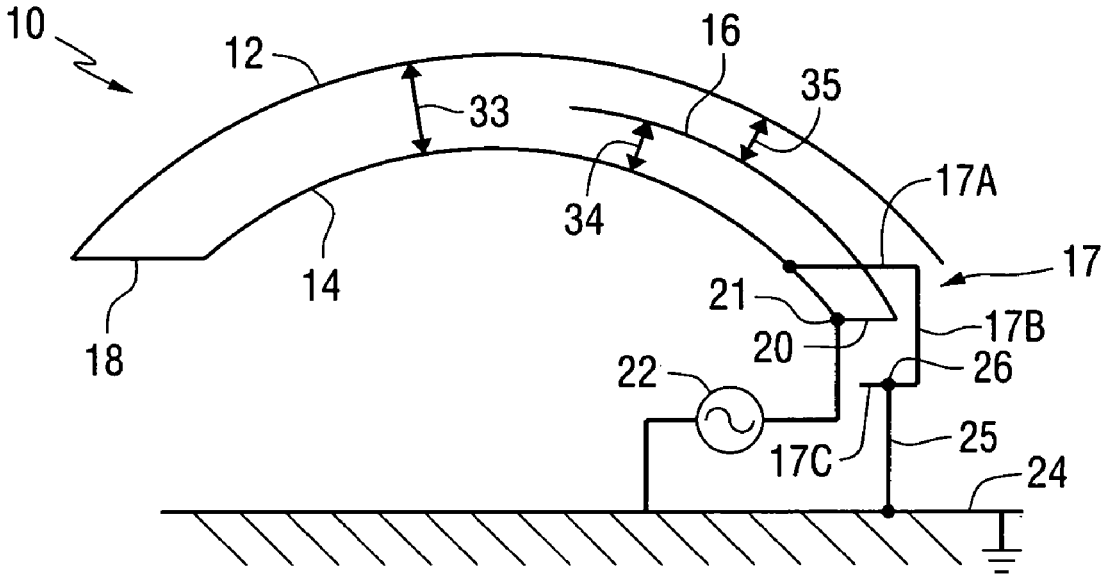
FIG. 1 illustrates an antenna constructed according to one embodiment of the present invention.

FIG. 1 illustrates an antenna 10 operative at one or more of at least three different resonant frequencies. The antenna comprises three arcuate proximate conductive segments 12, 14 and 16, wherein a material of each segment comprises conductive material. A conductive bridge 18 connects the segments 12 and 14, and a conductive bridge 20 connects the segments 14 and 16. A conductive segment 17 (comprising subsegments 17A, 17B and 17C) is electrically connected to and extends from the strip 14 as will be described below. Although FIG. 1 illustrates the segments 12, 14 and 16 as having the same general curvature or radius, this is not necessarily required by the present invention. An electrical length of each of the conductive segments of the antenna is longer than a physical length of the segment due to the coupling between the segments.

A signal terminal 21 of the antenna 10 is connected to a signal source 22 of a communications device (when operative in the transmitting mode). In the receiving mode, the received signal is fed to receiving circuitry (not shown) of the communications device from the signal terminal 21. Although the signal terminal 21 is located at a single point in FIG. 1, those skilled in the art recognize that the signal terminal can be shifted to other locations on the antenna structure.

The antenna 10 is connected to a ground plane 24, which typically comprises a ground plane in the communications device, via a conductive element 25 extending from a ground terminal 26. In another embodiment, the ground terminal 26 can be moved to another location on the antenna 10.

In the embodiment of FIG. 1, the segment 17 comprises a reversed C-shaped segment with the subsegment 17A connected to the segment 14 and the subsegment 17C connected to ground at the ground terminal 26. Although the segment 17 may appear physically shorter than the segment 16, an electrical length of the segment 17 is longer than an electrical length of the segment 16. This difference in electrical lengths is attributable to operation of the segment 16 as a quarter-wave monopole and operation of the segment 17 as a portion of a loop antenna or a PIFA antenna (planar inverted F-shaped antenna).

An exemplary communications device operable with the antenna 10 comprises a handset or cellular telephone capable of receiving digital multimedia broadcast signals from a satellite or a terrestrial source. In one application, a satellite transmits two signals to the earth. One signal comprises a direct signal broadcast to handsets (at a frequency of, for example, 2.64 GHz with right-hand circular polarization). A second signal is transmitted to a base-station (at for example, 12 GHz). The base-station (referred to in the communications system as a gap-filler) terrestrially rebroadcasts the received signal to handsets (at for example, 2.64 GHz with linear polarization). Thus, each handset receives two separate signals, one signal directly from the satellite and a second from the gap-filler base station, but both signals have substantially the same information content. The user's handset selects the best-received signal based on a received signal quality metric. In one application, the antenna 10 operates to receive the terrestrial gap-filler signal, as well as a global positioning signal and a cellular telephone signal, each signal received at a different frequency.

In one embodiment the antenna 10 is resonant in three spaced-apart frequency bands (and thus referred to as a tri-band antenna): a first frequency band (f1) of 824–894 MHz (for CDMA communications), a second frequency band (f2) of 1.575 GHz (for global positioning system (GPS) communications) and a third frequency band (f3) of 2.63–2.65 GHz (for digital multimedia broadcast (DMB) communications). A length of the various segments and a distance between segments (identified in FIG. 1 by reference characters 33, 34 and 35) are selected to provide an antenna resonant condition at the desired operating frequencies. In particular, the distance between segments determines a parasitic capacitance or capacitive coupling between the segments, which affects the effective length of the segments and thus the segment resonant frequency. For example, the distance 34 is directly related to the highest resonant frequency f3, i.e., as the distance 34 increases, the resonant frequency f3 increases and vice versa. Generally, the segments 12/14/18 cooperate to provide a resonant condition at the lowest frequency f1, the segment 16 is resonant at the highest frequency f3 and the segment 17 is resonant at the intermediate frequency f2.

In a preferred embodiment, various components of the antenna 10 are formed from a length of conductive material (such as copper) formed into the illustrated shapes or a shape functionally similar thereto, by simple bending and curve-inducing operations that can be easily performed manually or using a material bending jig. In one embodiment, for example, one or more of the segments 12, 18, 14, 20, 16 and 17 are formed from a single length of conductive material. As explained further below in conjunction with FIG. 2, the segment 17 can also be formed from the same length of conductive material. In one embodiment, a width of the conductive material is about 4–4.5 mm. Larger and smaller widths are also suitable.

Figure 2:
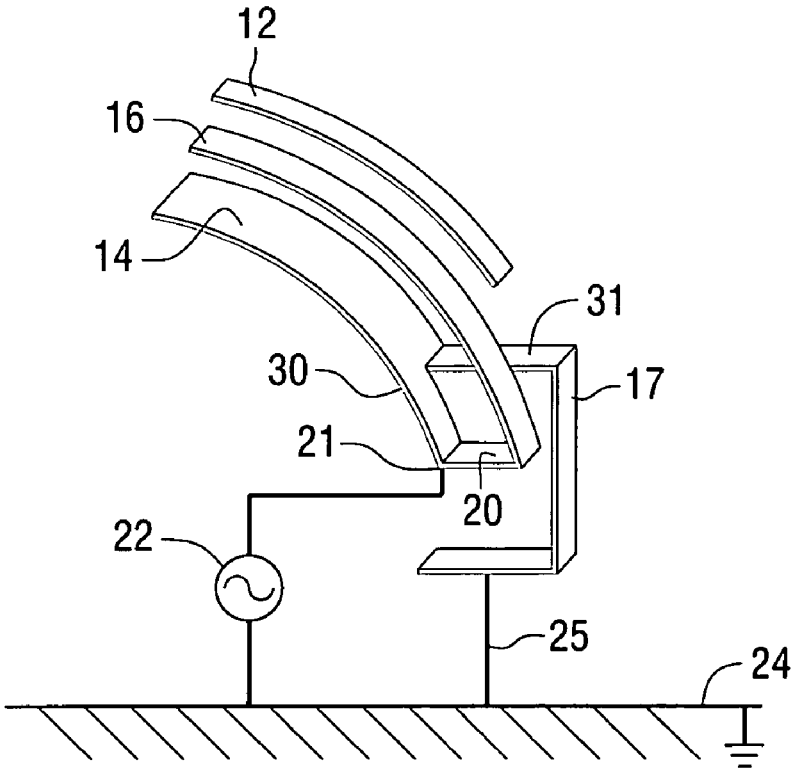
FIG. 2 is a perspective view of a region of the antenna of FIG. 1.

FIG. 2 illustrates a close-up view of a region of the antenna 10, including the segment 17. It can be seen that the conductive strip comprising the segment 14 is longitudinally bifurcated, creating a longitudinal gap or split to form legs 30 and 31. The bridge 20 and the segment 16 are formed from the leg 30. The leg 31 is configured as shown and comprises the segment 17. Although the embodiment of FIG. 2 is preferred for manufacturability, i.e., the ability to form the antenna elements from a single conductive strip, this is not required for operation of the antenna 10 as described herein.

Figure 3:
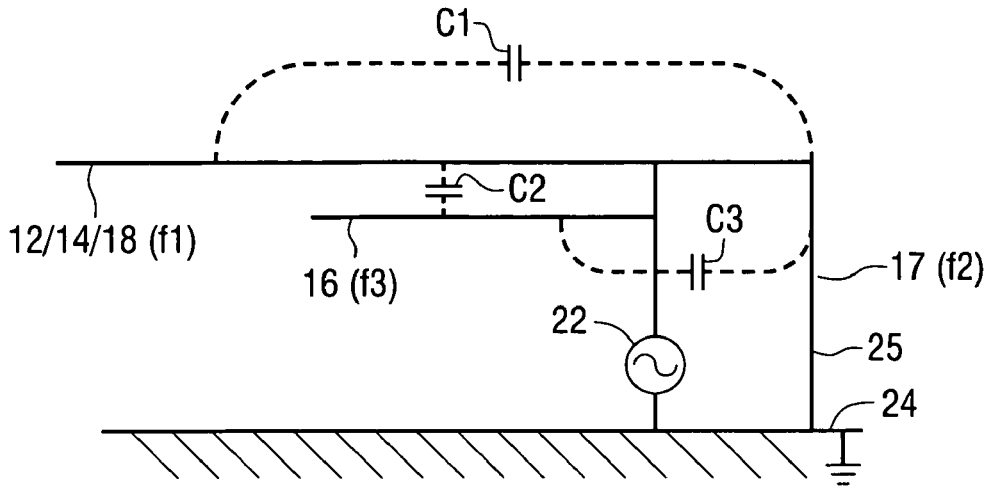
FIG. 3 illustrates capacitive coupling between elements of the antenna of FIG. 1.

FIG. 3 depicts an equivalent circuit for an embodiment of the antenna 10, schematically illustrating the segments and parenthetically identifying the resonant frequency band principally associated with each segment. Those skilled in the art recognize that the designation of one or more conductive segments as the principal radiating/receiving structure for a specific resonant frequency is an over simplification of a very complex process of electromagnetic field interactions between the segments.

FIG. 3 further identifies, in phantom, parasitic coupling capacitors C1, C2 and C3 formed by the charge build-up on the antenna segments, creating a capacitance in the space between segments. The interaction of the antenna segments due to these parasitic capacitances cause each segment to exhibit an electrical length that is longer than the segment's physical length. Those skilled in the art recognize that the designation of one or more parasitic capacitances between any two or three antenna elements is an over simplification of a very complex process of coupling between the segments. The resonant length comprising the segments 12 and 14 and the bridge 18 is shown as the longest segment and thus resonates at the lowest frequency, f1. In one embodiment, the segment 17 is the physically shortest segment, but exhibits a resonant length that is longer than the resonant length of the segment 16 and resonates at an intermediate frequency f2. The segment 16 exhibits the shortest resonant length and resonates at the highest frequency f3.

Figure 4:
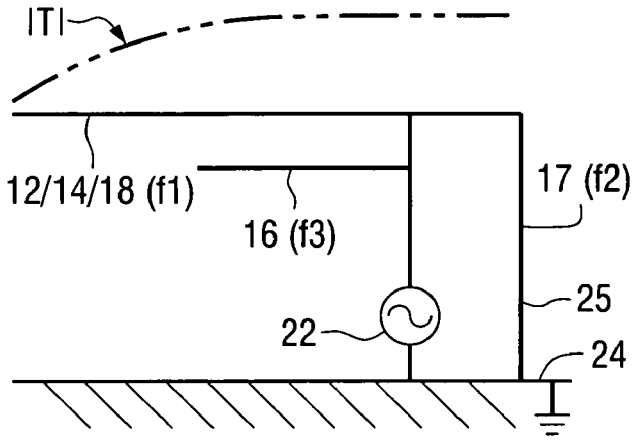
FIGS. 4–6 illustrate the current distribution in the elements of the FIG. 1 antenna.
Figure 5:
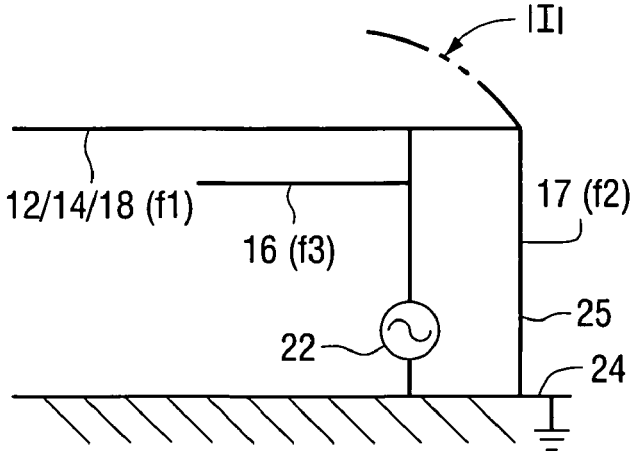
Figure 6:
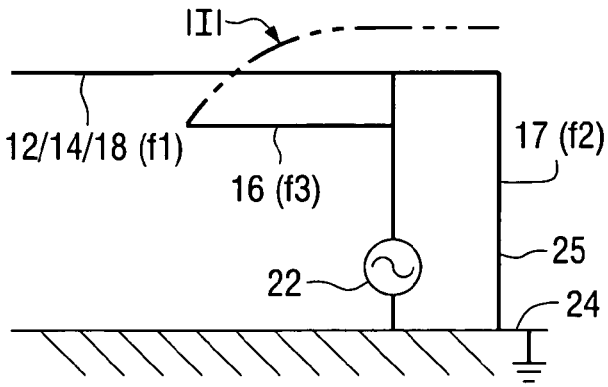

FIGS. 4–6 depict the current distribution (magnitude labeled |I|) when one of the segments 12/18/14 (f1) (see FIG. 4), segment 17(f2) (see FIG. 5) or segment 16 (f3) (see FIG. 6) is operating at resonance.

In yet another embodiment, the segments 12, 18 and 14 comprise linear segments and are oriented to form a linear conductive element, in lieu of the curved element illustrated in FIG. 1. Such an embodiment increases the radiation efficiency by increasing the antenna aperture, and changes the resonant frequency f3 by changing the coupling (and thus the parasitic capacitance) between the element 16 and the other elements of the antenna.

Figure 7:
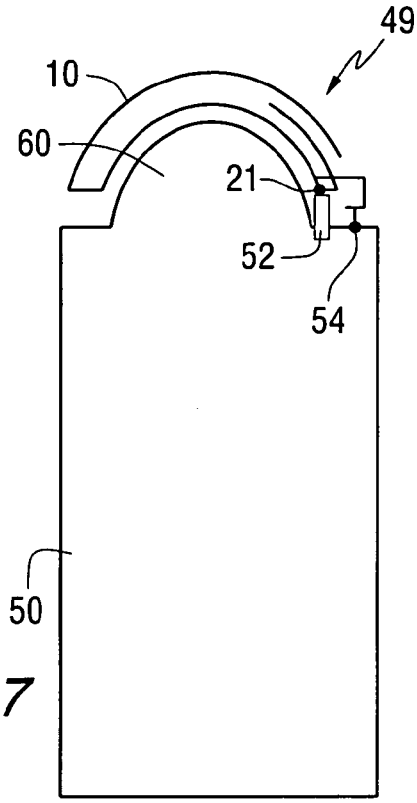
FIG. 7 illustrates the antenna of FIG. 1 installed in a communication device.

FIG. 7 illustrates the antenna 10 installed in a communications device 49 further comprising a printed circuit board 50 for placing and interconnecting operative components of the communications device 49. In particular, the printed circuit board 50 comprises a signal feed 52 for connection to the signal terminal 21 of the antenna 10, and a ground connection 54 for connection to the conductive element 25 of the antenna 10. Generally, a region of the printed circuit board 50 serves as a ground plane for the communications device and includes the ground connection 54. Disposition of the antenna segments proximate a ground plane may affect the electrical length or other properties of the segments, such that one or more of the physical parameters of the segments may be adjusted to establish a resonant condition at the desired frequency.

In one embodiment, a camera of the communications device is disposed in a region 60. Thus in one embodiment, the segments of the antenna 10 are curved to encircle the region 60, creating an efficient and compact integration of the antenna 10 into the communications device 49. However, in another embodiment where the antenna 10 is not required to fit into a region of a communications device presenting a curved envelope, the antenna segments can comprise linear elements in a shape as required to fit within the available envelope and provide the desired radiating and receiving properties.

Figure 8:
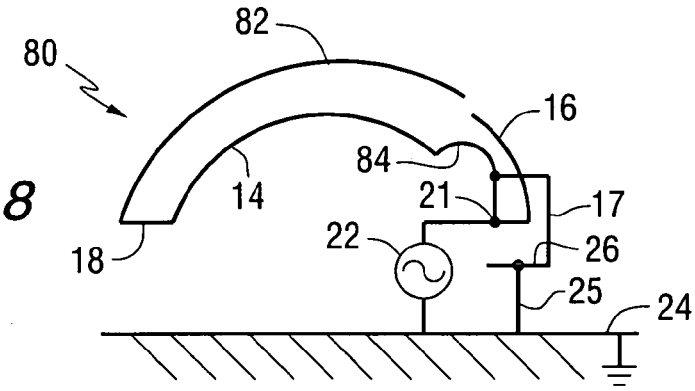
FIGS. 8–12 illustrate additional embodiments of an antenna of the present invention.

FIG. 8 illustrates another embodiment of the present invention in the form of an antenna 80 comprising a segment 82 that is shorter than the segment 12 of FIG. 1. Thus, the f1 resonant frequency f1 of the antenna 80 is higher than the f1 resonant frequency of the antenna 10. Other antenna segments can similarly be lengthened or shortened to change one or more antenna resonant frequencies.

The antenna 80 further comprises a curved region 84 within the segment 14 for increasing the bandwidth and radiation efficiency of the antenna at the low band resonant frequency f1. Use of the curved region 84 may be beneficial in certain embodiments of the present invention, but is not necessarily required in all embodiments.

Figure 9:
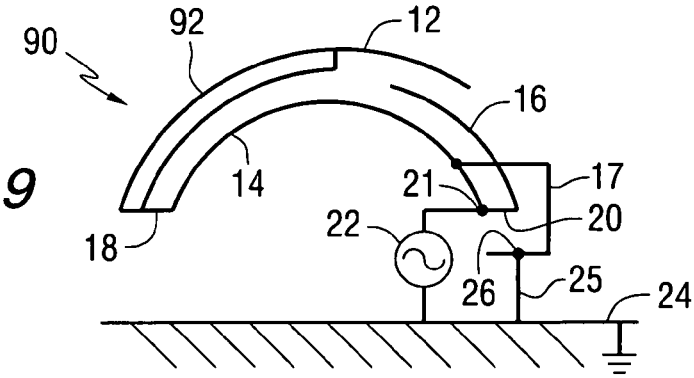

FIG. 9 illustrates an embodiment of an antenna 90, comprising a plate 92 extending from the segment 12. Use of the curved plate 92 may be beneficial in certain embodiments for increasing the bandwidth and the radiation efficiency of the antenna.

Figure 10:
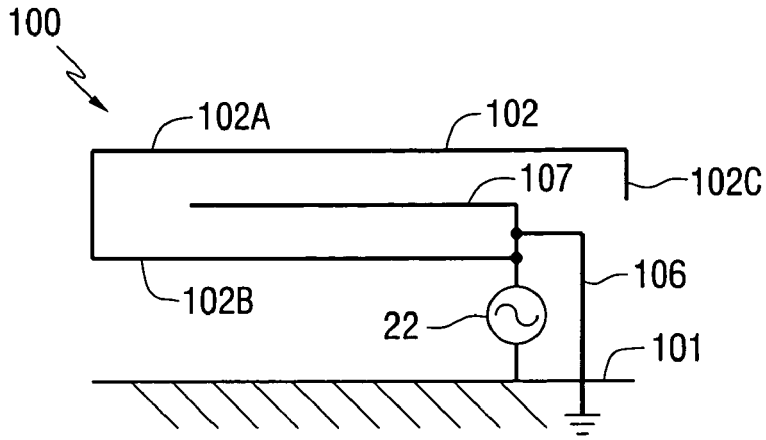
Figure 11:
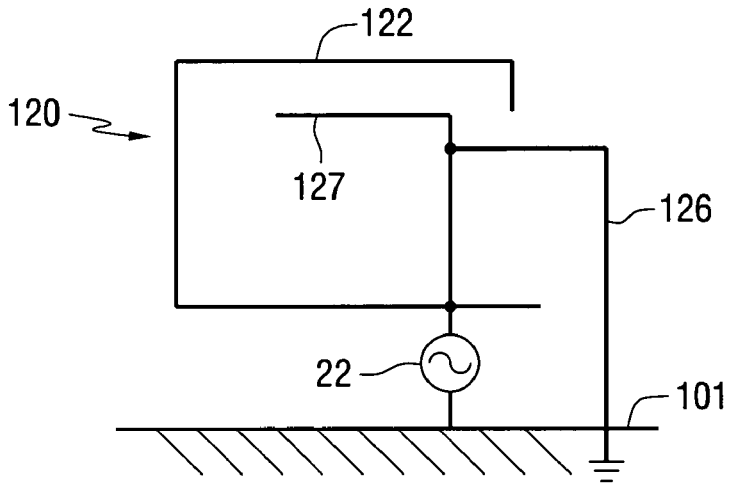
Figure 12:
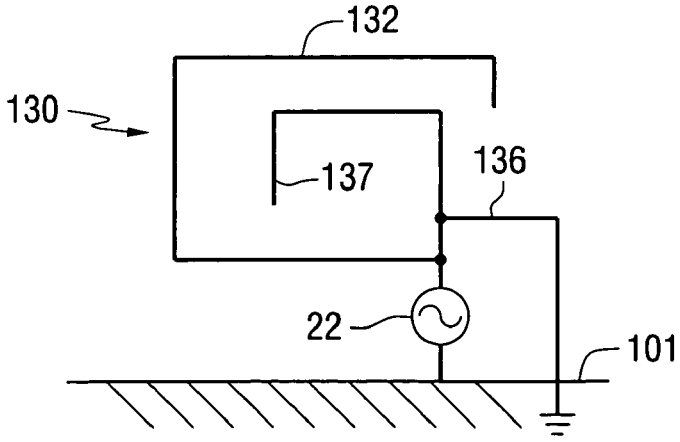

FIGS. 10–12 illustrate additional embodiments of a tri-band antenna constructed according to the teachings of the present invention, wherein the various antenna segments are differently shaped or have a different length than the elements in the embodiments described above. FIG. 10 illustrates an antenna 100 disposed over a ground plane 101 and comprising a folded segment 102 resonant at a first frequency (f1), a segment 106 resonant at a second frequency (f2), and a segment 107 resonant at a third frequency (f3), where f1<f2<f3. The segment 107 is disposed between legs 102A and 102B of the folded segment 102. The folded segment 102 further comprises a terminal segment 102C generally directed downwardly in a direction toward the ground plane 101. The segments 106 and 107 can be formed by bifurcating the segment 102 as described above in conjunction with FIG. 2.

In FIG. 11, an antenna 120 comprises a segment 122 resonant at a first frequency (f1), a segment 126 resonant at a second frequency (f2), and a segment 127 resonant at a third frequency (f3), where f1<f2<f3. The segment 127 is disposed within an interior region bounded by the segment 122.

In FIG. 12, an antenna 130 comprises a segment 132 resonant at a first frequency (f1), a segment 136 resonant at a second frequency (f3), and a segment 137 resonant at a third frequency (f2), where f1<f2<f3.

The embodiments of FIGS. 10–12 operate similarly to the embodiments described above.

The dimensions, shapes and relationships of the various antenna elements and their respective features as described herein can be modified to permit operation in other frequency bands with other operational characteristics, including bandwidth, radiation resistance, input impedance, radiation efficiency, etc. The antenna is therefore scalable to another resonant frequency by dimensional variation. Those skilled in the art recognize that the interaction and coupling between the elements of a multi-frequency antenna are not susceptible to simple and precise explanation. Further, the affect of these phenomena on antenna performance is complex and not easily determinable. Thus, the description of the various embodiments of the present invention should be interpreted in light of these considerations.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope. For example, different sized and shaped elements can be employed to form an antenna according to the teachings of the present invention. Therefore, it is intended that the invention not be limited to the embodiments taught herein, but that the invention will include all embodiments falling within the scope of the appended claims.

What is claimed is:

1. An antenna for receiving radio frequency signals, comprising:

a first resonant segment comprising first and second connected conductive strips a width of the first conductive strip bifurcated along a partial length thereof to form a first and a second bifurcated segment;

the first bifurcated segment extending from a plane of the first conductive strip and forming a second resonant segment;

the second bifurcated segment extending from the plane of the first conductive segment and forming a third resonant segment; and wherein the first segment is resonant at a first frequency, the second segment is resonant at a second frequency and the third segment is resonant at a third frequency.

2. The antenna of claim 1 wherein the first frequency is lower than the second frequency and the second frequency is lower than the third frequency.

3. The antenna of claim 1 wherein the third resonant frequency is responsive to a distance between the first and the third resonant segments and a length of the third segment.

4. The antenna of claim 1 wherein the first resonant segment comprises the first and the second conductive strips and a bridging segment connecting the first and the second conductive strips, the first and the second conductive strips each comprising a curved conductive strip, the curved conductive strips substantially concentric and spaced-apart by a distance, and wherein the first resonant frequency is responsive to the distance and a length of the first resonant segment.

5. The antenna of claim 1 further comprising a signal terminal proximate an end of the first resonant segment.

6. The antenna of claim 5 wherein a length of the first segment comprises a distance between the signal terminal and an open end of the first segment, and a length of the third segment comprises a distance between the signal terminal and an open end of the third segment.

7. The antenna of claim 5 wherein a length of the second segment comprises a distance between a point spaced apart from the signal terminal and an open end of the second segment.

8. The antenna of claim 1 further comprising a conductive plate extending from a partial length of the first resonant segment.

9. The antenna of claim 1 further comprising a ground plane disposed proximate the first, the second and the third segments, wherein the second segment is conductively connected to the ground plane.

10. The antenna of claim 9 wherein the second segment comprises a reversed C-shaped segment, an upper leg of the shaped segment extending from a point spaced apart from a signal terminal proximate an end of the first resonant segment, and a lower leg of the shaped segment conductively connected to the ground plane.

11. The antenna of claim 1 wherein a parasitic capacitor is formed between each of the first, the second and the third segments, and wherein one or more of the first frequency, the second frequency and the third frequency are responsive to the parasitic capacitors.

12. The antenna of claim 11 wherein an electrical length of one or more of the first, the second and the third segments is responsive to the parasitic capacitors.

13. The antenna of claim 1 wherein the first, the second and the third segments are spaced apart forming parasitic capacitors between pairs of segments, and wherein one or more of the first frequency, the second frequency and the third frequency are responsive to the parasitic capacitors.

14. An antenna, comprising:

a first resonant element comprising a first conductive strip having a first width and shaped to form a boundary defining an interior region and an exterior region;

a second resonant element comprising a second conductive strip extending into the exterior region and further comprising an extension of a first portion of the first width from the first conductive strip;

a third resonant element comprising a third conductive strip extending through an opening defined in the boundary into the interior region and further comprising an extension of a second portion of the first width from the first conductive strip; and wherein a plane of each of the second and the third conductive strips is different from a plane of the first conductive strip.

15. The antenna of claim 14 wherein a first antenna resonant frequency is responsive to an electrical length of the first element and capacitive coupling of the first element to the second and the third elements, and wherein a second antenna resonant frequency is responsive to an electrical length of the second element and capacitive coupling of the second element to the first and the third elements, and wherein a third antenna resonant frequency is responsive to an electrical length of the third element and capacitive coupling of the third element to the first and the second elements.

16. The antenna of claim 14 wherein the first resonant element comprises a laterally-facing U-shaped structure further comprising two substantially horizontal leg sections and a substantially vertical bridging section that together define an opening in the U-shaped structure, and wherein the third resonant element extends through the opening into the interior region.

17. The antenna of claim 14 wherein the first, second and third resonant elements are conductively connected and capacitively coupled.

18. The antenna of claim 14 further comprising a signal terminal for supplying a signal when the antenna is operative in a receiving mode.

19. The antenna of claim 18 wherein the first and the third resonant elements are conductively connected at the signal terminal.

20. The antenna of claim 14 wherein the second resonant element is conductively connected to the first resonant element spaced apart from the signal terminal.

21. The antenna of claim 14 wherein the second resonant element is conductively connected to a ground.

22. The antenna of claim 14 wherein the antenna is disposed over a ground plane to which the second resonant element is conductively connected.

23. The antenna of claim 14 wherein a resonant frequency of each of the first, the second and the third elements is responsive to an effective electrical length of the first, the second and the third elements, respectively.

24. A communications device for receiving radio frequency signals, comprising a substrate having a ground region disposed thereon;

a plurality of device components disposed within an interior region of the communications device and defining a space envelope within the interior region;

an antenna shaped to fit within the space envelope, the antenna comprising:

a first resonant element shaped according to the space envelope to form a boundary defining an interior region and an exterior region;

a second resonant element disposed in the exterior region;

a third resonant element disposed in the interior region; and wherein a first resonant frequency is responsive to an electrical length of the first element and capacitive coupling of the first element to the second and the third elements, and wherein a second antenna resonant frequency is responsive to an electrical length of the second element and capacitive coupling of the second element to the first and the third elements, and wherein a third antenna resonant frequency is responsive to an electrical length of the third element and capacitive coupling of the third element to the first and the second elements.

25. The antenna of claim 24 wherein the first resonant frequency is lower than the second resonant frequency and the second resonant frequency is lower than the third resonant frequency.

26. The antenna of claim 24 wherein the second resonant element is conductively connected to the ground region.

27. The antenna of claim 24 further comprising a signal terminal for supplying a signal to electronics components mounted on the substrate when the antenna is operative in a receiving mode.

28. The antenna of claim 27 wherein the first and the third resonant elements are conductively connected at the signal terminal.

29. The antenna of claim 24 wherein the second resonant element is conductively connected to the first resonant element proximate the signal terminal.

30. The antenna of claim 24 wherein the first resonant element comprises two concentric spaced-apart arcuate conductive elements conductively joined by a bridging element conductively connected between a first end of each of the arcuate conductive elements and forming an opening at a second end of each of the arcuate elements, and wherein a shape of the arcuate elements is responsive to a shape of the space envelope.

31. The antenna of claim 30 wherein the spaced-apart arcuate conductive elements define a gap therebetween, and wherein the third resonant element extends through the opening and is disposed within the gap and concentric with the arcuate conductive elements.

* * * * *